United States Patent [19]

Burt DuPont

[11] Patent Number: 4,637,604

[45] Date of Patent: Jan. 20, 1987

[54] PHYSICAL THERAPY DEVICE

[76] Inventor: Blanche A. Burt DuPont, 8220 Hidden Lake Dr. S., Jacksonville, Fla. 32216

[21] Appl. No.: 644,692

[22] Filed: Aug. 27, 1984

[51] Int. Cl.[4] ..... A63B 21/00; A63B 23/04

[52] U.S. Cl. ..... 272/73; 272/93; 272/114

[58] Field of Search ..... 272/73, 144, 64, 93, 272/52; 128/25 R; 297/195, 203

[56] References Cited

U.S. PATENT DOCUMENTS

| | | | |
|---|---|---|---|
| 1,493,084 | 5/1924 | Strniste | 272/52 |
| 1,562,700 | 11/1925 | Herring | 272/52 |
| 2,560,963 | 7/1951 | Kornegay | 297/195 |
| 3,432,164 | 3/1969 | Deeks | 272/73 |
| 3,640,525 | 2/1972 | Proctor | 272/134 X |
| 3,754,787 | 8/1973 | Garber | 297/195 X |
| 3,843,118 | 10/1974 | Annas et al. | 272/132 |

*Primary Examiner*—Robert A. Hafer
*Assistant Examiner*—Kathleen J. D'Arrigo
*Attorney, Agent, or Firm*—Arthur G. Yeager

[57] ABSTRACT

A straddle seat chair and stand with a post supporting an upwardly directed handle bar to the seat for the patient to grip manually while sitting or standing and exercising the legs by dancing on a base or adjacent thereto. A ledge extends above the seat forwardly and laterally of the post. An adjustably inclined footrest is positionable generally below the post and handle bar and supports the patient's feet thereon while sitting.

23 Claims, 5 Drawing Figures

PHYSICAL THERAPY DEVICE

BACKGROUND OF THE INVENTION

In the field of physical therapy there are tremendous needs for many specialized devices to assist patients to move and/or exercise one or more parts of the body, for example, some children have central nervous system dysfunction which impairs proper leg movements. In the treatment of such a disorder it is frequently important to move and exercise the impaired leg while the remainder of the body maintains an appropriate static posture. Flexing, extending and lifting the leg can quickly become boring to a child so there has been a need to provide the required exercise activity in a manner that is both mentally and motorically stimulating to the child.

it is an object of this invention to provide a novel physical therapy device. It is another object of this invention to provide a novel dancing exercise device to assist the therapist in maintaining the child's postural alignment and control. It is still another object to provide a chair to be used by a child while performing developmental dance exercises. Still other objects will appear from the more detailed disclosure which follows.

BRIEF DESCRIPTION OF THE INVENTION

This invention relates to a child's physical therapy chair and stand comprising a solid planar floor base, a horizontally extending straddle seat member having a forward end and a rearward end, and a vertical rigid member supported at its lower end on the floor base with its upper end attached to and supporting such seat member. A generally vertical post is affixed to and projects upwardly from the forward end of such seat member, and a handle bar having a central horizontal portion and, at each end thereof, an upwardly extending and outwardly diverging handle portion. Releasable means are connected to the post for adjustably fixing the handle bar central portion to the post.

In specific embodiments of this invention there is an upwardly directed ledge attached to the forward end of the seat member with hand grips provided on the end portions of the handle bar.

BRIEF DESCRIPTION OF THE DRAWINGS

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
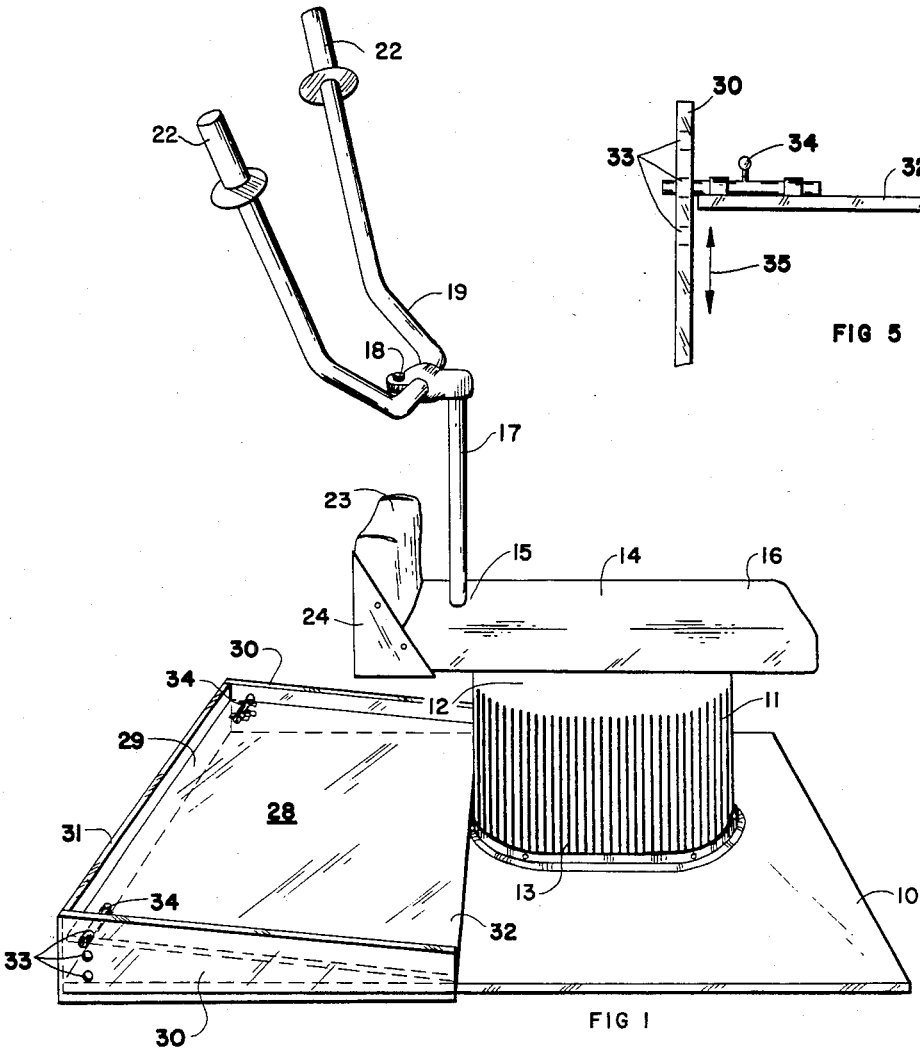
FIG. 1 is a side perspective elevational view of the physical therapy device of this invention.
Figure 2:
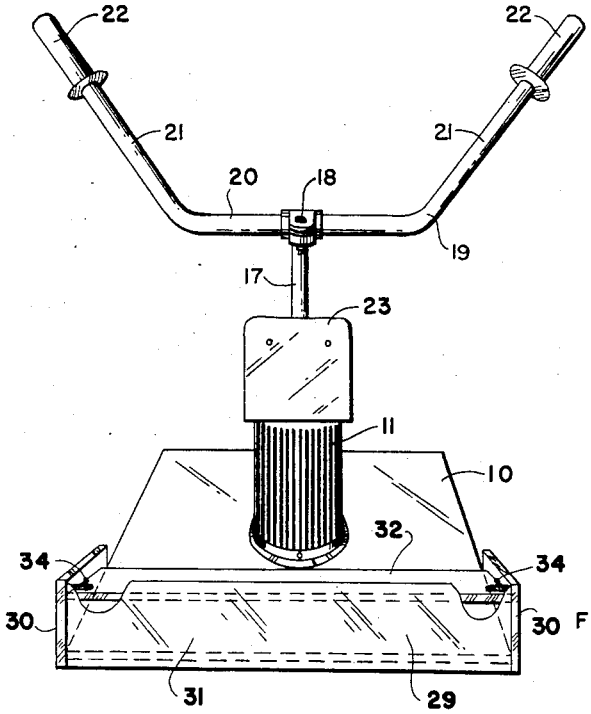
FIG. 2 is a front perspective view of the device of FIG. 1.

FIGS. 1 and 2 show the physical therapy device in the form of a stand and chair of this invention. A floor base 10 supports the entire chair and preferably is a solid flat planar surface that will function as a sounding board for tap dancing. A covering of Formica or the like on a plywood base, for example, enhances the sharp sounds of tap dancing. Vertical support 11 is affixed at its lower end 13 to floor base 10 by any suitable means, such as screws, adhesives, etc. Fastened to upper end 12 of vertical support 11 is a horizontally extending straddle seat member 14 having a forward end 15 and a rearward end 16. Preferably seat member 14 is padded for comfort and is generally in the shape of a long narrow rectangle without sharp corners or the like. Vertical support 11 includes an elliptical columnar structure which provides stable support for seat member 14 over a substantial portion of its length from forward end 15 to rearward end 16 thereof. It is to be understood that many other types or shapes of vertical support 11 would function appropriately to maintain seat member 14 in a stable rigidified horizontal position.

On the forward end 15 of seat member 14 there is attached a vertical post 17 to which is connected a handle bar 19 by an adjustable clamp 18. This combination of post 17, clamp 18, and handle bar 19 is generally similar to the handle bar and its mounting means for a common bicycle. Handle bar 19 has a horizontal central portion 20 which is attached to post 17 by clamp 18. At the ends of central portion 20 there are end portions 21 positioned angularly with respect to central portion 20 and generally diverge outwardly from central portion 20. Over the ends of end portions 21 there are placed hand grips 22. Although handle bar 19 may be adjustably rotated about its attachment to clamp 18 to position end portions 21 and hand grips 22 in any desired position, they are preferably placed in the upward position with the axes of the end portions 21 or grips 22 being 90° or more as measured counterclockwise from the horizontal seat 14, shown in FIGS. 1 and 2, for therapeutical purposes as explained below.

The forward end 15 of seat member 14 is preferably fitted with an upwardly projecting ledge member 23 which may be secured in that position by triangular brackets 24 attached at each side of seat member 14. Ledge member 23 is also preferably padded, similarly to seat member 14, and serves to protect the patient from harm by bumping into post 17 or clamp 18, or the like when the patient is standing or exercising in front of the device on the front portion 28 of floor base 10.

Figure 5:
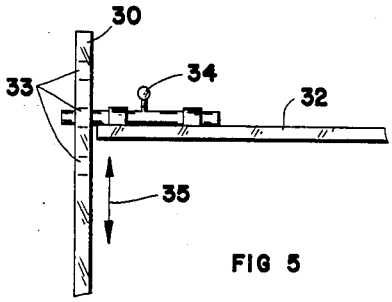
FIG. 5 is an enlarged front elevational view of the adjustment means for the footrest.
Figure 3:
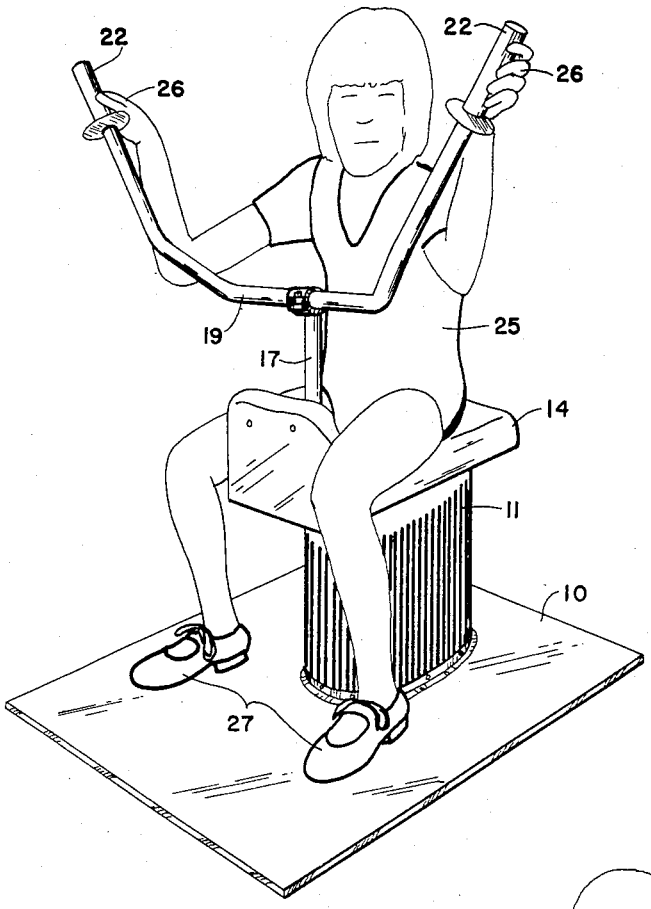
FIG. 3 is a perspective view of the device of FIG. 1 being used by a sitting patient with the footrest removed.
Figure 4:
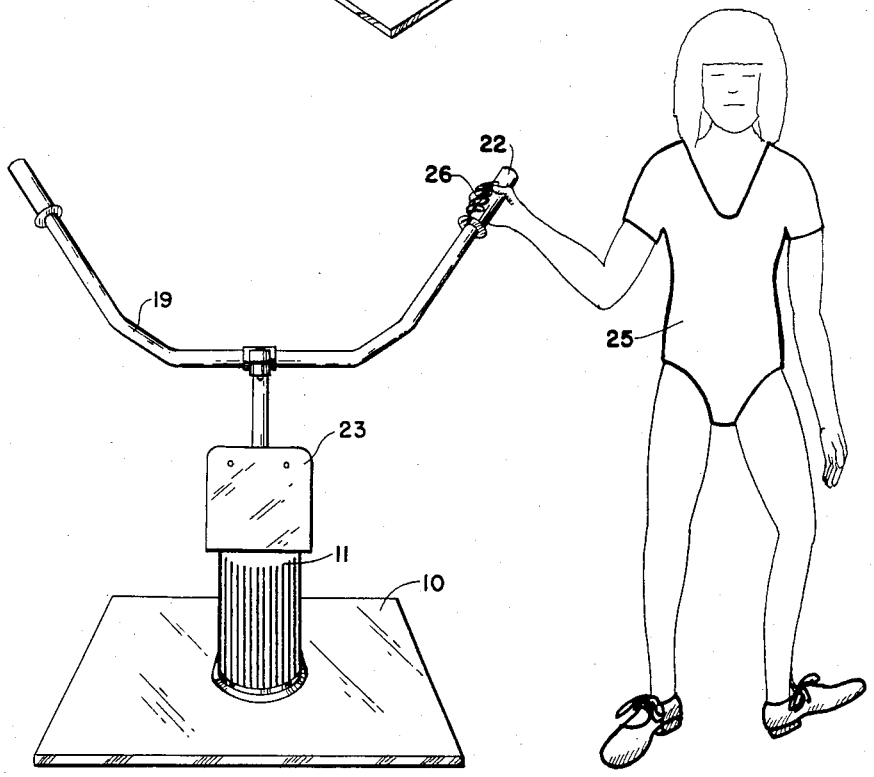
FIG. 4 is a front perspective view of the device of FIG. 3 being used by a standing patient.

An alternative feature shown in FIGS. 1 and 2 is footrest 29 which can be placed over the front portion 28 of floor base 10 as desired. Footrest 29 can be permanently attached over portion 28 of floor base 10 or made to be removeable. Footrest 29 comprises side pieces 30, crosspiece 31 and footboard 32. Side pieces 30 are provided with a plurality of holes 33 adjacent crosspiece 31 to mate with slide bolts 34 attached to the forward portion of the footboard 32. This provides an adjustability to the inclination of footboard 32. For patients with short legs it is advisable to employ footrest 29 but for patients with long legs the use of footrest 29 is not necessary (as is shown in FIGS. 3 and 4.) FIG. 5 shows the slide bolt affixed to footboard 32 and mated with one of holes 33 in side piece 30. Slide bolt 34 can be withdrawn from contact with holes 33 to allow the forward portion of footboard to be moved upward or downward as shown by arrow 35 to adjust the inclination of footboard 32 from floor base 10.

The device of this invention is used principally as an adjunct to the physical therapy program for children who need to exercise their legs while learning to maintain proper sitting balance. One position for the exercise is shown in FIG. 3 where the patient 25 is seated straddling seat 14 with hands 26 holding the hand grips 22. Feet 27 rest on floor base 10 or on footboard 32 (FIG. 1) and are moved about on base 10 or footboard 32 in a tap dance routine to provide exercise for the legs, feet, and back of patient 25. Another position is shown in FIG. 4 where the patient 25 is standing and holding one hand 26 onto hand grip 22. Still another position is for the patient to stand on floor base 10 (with footrest 29 removed) facing handle bar 19 with both hands 26 holding hand grips 22 similarly, but facing in the opposite direction, to that of FIG. 3. In all of these positions specifically modified tap dancing exercises can be employed for therapy purposes.

The chair and stand in accord with this invention is of particular use in treating patients having certain problems with balance and movement secondary to central nervous system dysfunction.

Straddle seat 14 facilitates bilateral hip abduction and external rotation with knee flexion and therefore, increases the patient's base of support. This facilitates trunk control and improved extension down through the lumbar spine. During a lifting activity with one lower extremity, the weight is shifted laterally over the opposite side, thus facilitating elongation of the trunk on the weight bearing side, if the hands are positioned on the upwardly extending handle bar grips. The unweighted leg can be encouraged to react to the weight shift with an equilibrium type reaction facilitated by specific tap steps, like the heel dig or the shuffle. Once this is accomplished, the patient can be encouraged to reshift his weight to the other hip and actively (passively, if the therapits's support is necessary) reelongate the original laterally flexed side. Controlled lateral flexion is a critical movement component experienced too infrequently by children having central nervouus system dysfunction. Therefore, righting and equilibrium responses are commonly found to be problem areas with such children, and appropriate physical therapy techniques are found to be necessary for remediation.

handle bar 19 should be oriented in such a manner to facilitate bilateral upper extremity humeral flexion and external rotation with abduction, while the elbows should be extended. This upper extremity positioning helps to facilitate scapular adduction, and depression, an erect trunk, and the secondary results of bilateral abduction and external rotation of the lower extremities.

The patient can elevate and extend his trunk by reaching up and placing his hands on the hand grips 22. He can then mobilize his lumber spine and stabilize the hip-pelvic articulation by active hip flexion. Further elevation into standing occurs when the patient moves his hands to the central portion 20 and pushes down strongly while extending both knees. Once standing, the patient can bring each leg forward under his trunk by weight shifting with upper extremity support through the heels of the hands. Lateral weight shifting can then be imitated while foot placement awareness is facilitated via the tap dancing exercises. The most useful handle bar position is between 90° forward shoulder flexion and 90° shoulder abduction (as in FIG. 3 when sitting). Elbows should be permitted to extend fully.

The height of seat member 14 should allow for 80°–90° hip flexion, and 90° knee and ankle flexion. The width of seat member 14 should permit 20°–30° hip abduction bilaterally when the patient is sitting in straddling position on seat member 14.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what is desired to secure by Latters Patent of the United States is:

1. A therapy device for exercise comprising a solid planar floor base, and elongated vertical member having an upper end and a lower end, said lower end being rigidly affixed to said base, an elongated horizontal straddle seat member having a central portion between its forward and rearward ends with said central portion being rigidly affixed to said upper end of said vertical member substantially medially of the side edges of said seat member and substantially medially of said forward and rearward ends, a substantially vertical post rigidly affixed to and projecting upwardly from said forward end of said seat, upwardly extending ledge means supported by said seat member adjacent said vertical post for protecting the legs of a user from engagement with said vertical post during sitting and exercising on said device, and an elongated handle bar member adjustably mounted generally laterally of said post, adjustable means mounted on said post for attachment to said handle bar member generally medially between the free end portions thereof, said free end portions of said handle bar member being positioned angularly with respect to each other for the user of said device.

2. A child's physical therapy chair and stand device comprising a solid planar floor base, a horizontally extending straddle seat member having a forward and rearward end, a vertical rigid member generally medially of said seat member and supported at its lower end on said floor base and its upper end attached to and supporting said seat member, a generally vertical post affixed to and projecting upwardly from the forward end of said seat member, said seat member including an upwardly extending ledge along said front end forwardly of said vertical post, and a handle bar having a central horizontal portion and at each end thereof an upwardly extending and outwardly diverging handle portion, means connected to said post for adjustably fixing said handle bar central portion to said post.

3. The device of claim 2 wherein said floor base extends laterally outward in all directions from and surrounding said vertical rigid member.

4. The device of claim 2 wherein said ledge extends laterally of said vertical post.

5. The device of claim 2 further comprising padding means on said seat member and said ledge to provide comfort and inhibit injury to the user.

6. The device of claim 2 wherein the lateral width of said straddle seat is greater than the lateral width of said vertical rigid support member throughout its length between said base and said seat.

7. The device of claim 2 wherein said vertical member is located substantially medially of the side edges of said floor base with the rearward end of said seat member being closely adjacent the rear edge of said floor base whereby the forward portion of said floor base adjacently forward of said handle bar may be used for dancing exercise.

8. The device of claim 2 wherein each said end of said handle bar is located between the vertical plane passing through said vertical post and said handle bar central portion and said plane rotated about said handle bar central portion as an axis to a position 45° from said vertical position.

9. The device of claim 2 wherein said ledge extends laterally of said vertical post, padding means on said seat member and said ledge to provide comfort and inhibit injury to the user, said vertical rigid member being located substantially medially of the side edges of said floor base with the rearward end of said seat member being closely adjacent the rear edge of said floor base whereby the forward portion of said floor base adjacently forward of said handle bar may be used for dancing exercise.

10. A child's physical therapy chair and stand device comprising a solid planar floor base, a horizontally extending straddle seat member having a forward and rearward end, a vertical rigid member generally medially of said member and supported at its lower end on said floor base and its upper end attached to and supporting said seat member, a generally vertical post affixed to and projecting upwardly from the forward end of said seat member, and a handle bar having a central horizontal portion and at each end thereof an upwardly extending and outwardly diverging handle portion, means connected to said post for adjustably fixing said handle bar central portion to said post, and an inclined footrest on the forward portion of said floor base.

11. The device of claim 10 wherein said inclined footrest includes a foot board having its rearward end resting on said floor base adjacent said vertical rigid member and its forward end adjustable to any desired height above said floor base.

12. A therapy device for exercise comprising a solid planar floor base, an elongated vertical member having an upper end and a lower end, said lower end being rigidly affixed to said base, an elongated horizontal straddle seat member having a central portion between its forward and rearward ends with said central portion being rigidly affixed to said upper end of said vertical member, a susbtantially vertical post rigidly affixed to and projecting upwardly from said forward end of said seat, said seat member including an upwardly extending ledge portion along said front end forwardly of said vertical post for protecting the legs of a user during sitting and exercising on said device, and an elongated handle bar member adjustably mounted generally laterally of said post, adjustable means mounted on said post for attachment to said handle bar member generally medially between the free end portions thereof, said free end portions of said handle bar member being positioned angularly with respect to each other for the user of said device.

13. The device of claim 12 wherein said end portions of said handle bar member diverge outwardly towards their free end portions, further comprising a hand grip mounted on each said end of said handle bar.

14. The device of claim 12 wherein said planar floor base extends laterally outward in all directions from and surrounding said vertical member to provide a firm foundation for exercise thereon by a user sitting on said seat member or standing on said floor base.

15. The device of claim 12 wherein said ledge portion extends laterally of each side of said vertical post.

16. The device of claim 12 further comprising padding means on said seat member and said ledge to shield the legs of the user and to provide comfort to the user.

17. The device of claim 12 wherein the lateral width of said straddle seat is greater than the lateral width of said elongated vertical member throughout its length between said base and said seat, said elongated vertical support having a greater width than the lateral width of said vertical post.

18. The device of claim 12 wherein said vertical member is located off-center of said floor base in alignment with the horizontal axis of said floor base with the rearward end of said seat member being closely adjacent the rear edge of said floor base whereby the forward portion of said floor base adjacently forward of said handle bar may be used for exercise by a user standing and gripping said handle bar.

19. The device of claim 12 wherein each said end portion of said handle bar is located between the vertical plane passing through said vertical post and perpendicularly to said horizontally extending seat member and a plane 45° conunterclockwise therefrom.

20. The device of claim 12 wherein said ledge extends laterally of said vertical post, padding means on said seat member and said ledge to shield the legs of the user and to provide comfort to the user, said vertical member being located off-center of said floor base in alignment with the horizontal axis of said floor base with the rearward end of said member being closely adjacent the rear edge of said floor base whereby the forward portion of said floor base adjacently forward of said handle bar may be used for exercise by a user standing and gripping said handle bar.

21. A therapy device fo exercise comprising a solid planar floor base, an elongated vertical member having an upper end and a lower end, said lower end being rigidly affixed to said base, an elongated horizontal straddle seat member having a central portion between its forward and rearward ends with said central portion being rigidly affixed to said upper end of said vertical member, a substantially vertical post rigidly affixed to and projecting upwardly from said forward end of said seat, and an elongated handle bar member adjustably mounted generally laterally of said post, adjustable means mounted on said post for attachment to said handle bar member generally medially between the free end portions thereof, said free end portions of said handle bar member being positioned angularly with respect to each other for the user of the said device, and an inclined footrest on said floor base forward of said vertical member and adapted to be contacted by the feet of the patient sitting on said straddle seat member.

22. The device of claim 21 wherein said foot rest includes a frame connected to an inclined footboard resting on said floor base at its rearward end adjacent said vertical member and adjustably raised above said floor base at its forward end.

23. The device of claim 22 wherein said footboard had affixed adjacent each of its forward corners a slide bolt adapted to mate with any of a plurality of holes in said frame.

* * * * *